US007328787B1

(12) United States Patent
Scruggs

(10) Patent No.: US 7,328,787 B1
(45) Date of Patent: Feb. 12, 2008

(54) STERI-CONTACTS KIT

(76) Inventor: Rufus Scruggs, 1042 Dayton Ave., Pomona, CA (US) 91766

( * ) Notice: Subject to any disclaimer, the term of this patent is extended or adjusted under 35 U.S.C. 154(b) by 422 days.

(21) Appl. No.: 10/948,355

(22) Filed: Sep. 22, 2004

Related U.S. Application Data

(60) Provisional application No. 60/505,774, filed on Sep. 24, 2003.

(51) Int. Cl.
*A45C 11/04* (2006.01)

(52) U.S. Cl. ..... 206/5.1; 134/901

(58) Field of Classification Search ..... 206/5.1, 206/205, 210; 134/117, 143, 901; 294/1.2
See application file for complete search history.

(56) References Cited

U.S. PATENT DOCUMENTS 2,707,552 A * 5/1955 Matthiesen ..... 206/537
2,940,589 A * 6/1960 Silverman ..... 206/5
3,326,358 A * 6/1967 Singleton ..... 206/5
3,424,486 A 1/1969 Corley
4,036,357 A * 7/1977 Czelen ..... 206/5.1
4,071,272 A 1/1978 Drdlik
4,238,134 A 12/1980 Cointment
4,429,786 A * 2/1984 Hucal ..... 206/5.1
4,905,819 A * 3/1990 Clements et al. ..... 206/5.1
5,069,494 A * 12/1991 Reinson et al. ..... 294/1.2
5,181,604 A * 1/1993 Ohta et al. ..... 206/5.1
5,348,358 A 9/1994 Selick
5,993,560 A * 11/1999 Wasak et al. ..... 134/6
2002/0063068 A1 * 5/2002 Faxe et al. ..... 206/5.1

* cited by examiner

*Primary Examiner*—David T. Fidei

(57) ABSTRACT

A combination apparatus that includes a contact lens storage area and a contact lens cleaning system. The combination apparatus also includes an area for storage of extra lens cups, an area for storage of sterile cleaning solution, and a cover to keep certain areas of the cleaning solution applicator sterile while not in use.

5 Claims, 2 Drawing Sheets

STERI-CONTACTS KIT

I. CROSS-REFERENCE TO RELATED APPLICATIONS

This application claims the benefit of U.S. Provisional Application No. 60/505,774, filed Sep. 24, 2003.

II. BACKGROUND OF THE INVENTION

The present invention concerns that of a new and improved combination apparatus that includes a contact lens storage area and a contact lens cleaning system.

III. DESCRIPTION OF THE PRIOR ART

U.S. Pat. No. 5,348,358, issued to Selick, discloses a contact lens insertion tool that allows user to apply contact lens by rotating tool until lens adheres to the eye.

U.S. Pat. No. 4,238,134, issued to Cointment, discloses a devise that removes a contact lens from the eye by suction, when squeezed and placed on the eye.

U.S. Pat. No. 4,071,272, issued to Drdlik, discloses an applicator for inserting and for removing a contact lens.

U.S. Pat. No. 3,424,486, issued to Corley, discloses a contact lens handling apparatus which positions the contact lens directly onto the pupil of the eye.

IV. SUMMARY OF THE INVENTION

The present invention concerns that of a new and improved combination apparatus that includes a contact lens storage area and a contact lens cleaning system. The combination apparatus also includes an area for storage of extra lens cups, an area for storage of sterile cleaning solution, and a cover to keep certain areas of the cleaning solution applicator sterile while not in use.

There has thus been outlined, rather broadly, the more important features of a contact lens storage area and cleaning system in order that the detailed description thereof that follows may be better understood, and in order that the present contribution to the art may be better appreciated. There are additional features of the contact lens storage area and cleaning system that will be described hereinafter and which will form the subject matter of the claims appended hereto.

In this respect, before explaining at least one embodiment of the contact lens storage area and cleaning system in detail, it is to be understood that the contact lens storage area and cleaning system is not limited in its application to the details of construction and to the arrangements of the components set forth in the following description or illustrated in the drawings. The contact lens storage area and cleaning system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present contact lens storage area and cleaning system. It is important, therefore, that the claims be regarded as including such equivalent constructions insofar as they do not depart from the spirit and scope of the present invention.

It is another object of the present invention to provide a contact lens storage area and cleaning system which has all of the advantages of the prior art and none of the disadvantages.

It is another object of the present invention to provide a contact lens storage area and cleaning system which may be easily and efficiently manufactured and marketed.

It is another object of the present invention to provide a contact lens storage area and cleaning system which is of durable and reliable construction.

It is yet another object of the present invention to provide a contact lens storage area and cleaning system which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
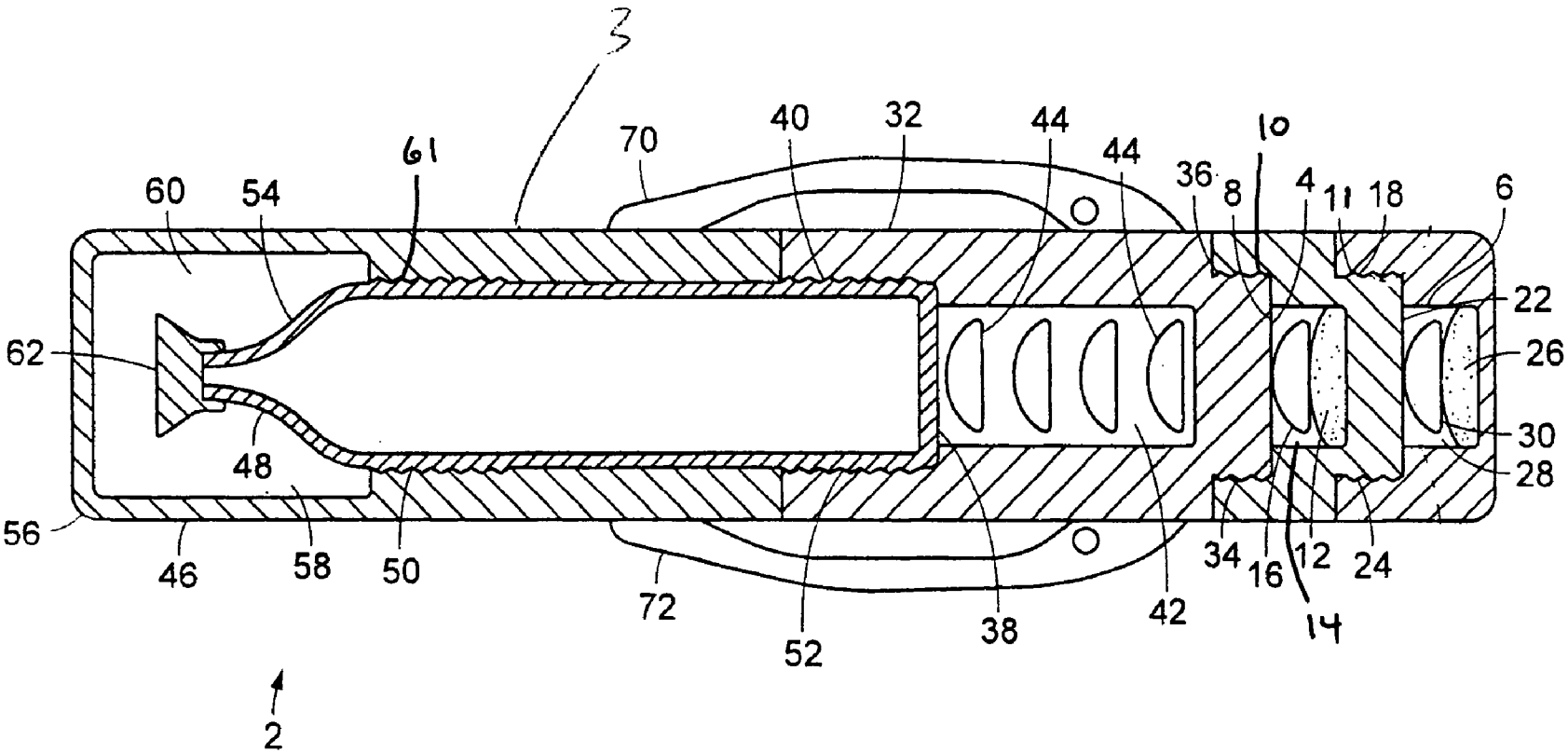
FIG. 1 shows a side see-through view of the combination apparatus.
Figure 2:
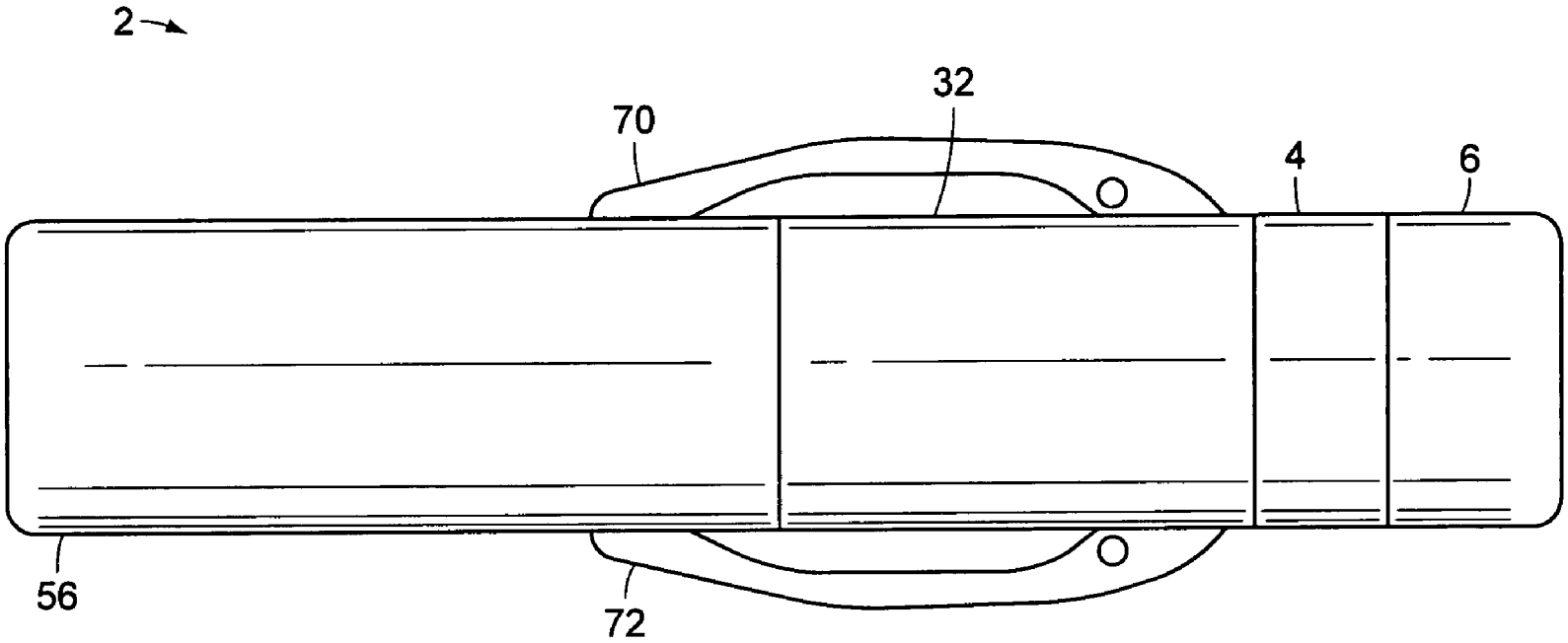
FIG. 2 shows a side view of the combination apparatus.

FIG. 1 shows a side see-through view of the combination apparatus 2, while FIG. 2 shows a side view of the combination apparatus 2. Combination apparatus 2 combines several features, including an area for storage of contact lens, an area for storage of extra lens caps, an area for storage of sterile cleaning solution, and a cover to keep certain areas of the cleaning solution applicator sterile while not in use.

Combination apparatus 2 comprises a container 3 that has two ends, a handle end and an applicator end. The handle end has two contacts lens storage compartments 4 and 6. Compartment 4 has two ends, a first end and a second end, with the second end of the compartment 4 being the handle end of the container 3. Compartment 4 is cylindrically shaped and has a central hole 8, with the central hole 8 having internal threads 10 on its inner perimeter. The internal threads 10 travel from the top of the hole (the top being the opening on the first end of the compartment 4) to about halfway down into the hole. The "bottom half" of the hole 8 is a little more narrow and has an included absorbent pad 12 attached to the bottom of the hole 8. This area forms a small compartment 14 in which an individual can store a contact lens 16 adjacent to the absorbent pad 12 within the compartment 14. The compartment 14 further has external threads 11 about the second end of the compartment 4.

Compartment 6 has two ends, a first end and a second end, with the second end of the compartment 6 having a cylindrical extension 18.

Compartment 6 is cylindrically shaped and has a central hole 22 located on the first end of compartment 6, with the central hole 22 having internal threads 24 on its inner perimeter. The internal threads 24 travel from the top of the hole (the top being the opening on the first end of the compartment 6) to about halfway down into the hole. The "bottom half" of the hole 22 is a little more narrow and has an included absorbent pad 26 attached to the bottom of the hole 22. This area forms a small compartment 28 in which an individual can store a contact lens 30 adjacent to the absorbent pad 26 within the compartment 28. The internal threads 24 are capable of being threadably attached to the external threads 11 about the second end of the compartment 4.

Lens cup storage compartment 32 has two ends, a first end and a second end, with the second end of the compartment 32 having a cylindrical extension 34 that has external threads 36 around its perimeter. These external threads 36 are capable of being threadably attached to the internal threads 10 within the hole 8 on the first end of the compartment 4.

Compartment 32 is cylindrically shaped and has a central hole 38 located on the first end of compartment 32, with the central hole 38 having internal threads 40 on its inner perimeter. While the central hole 38 on this section travels almost all the way to the second end of the compartment 32, the internal threads 40 travel from top of the hole (the top being the opening on the first end of the compartment 6) to only about one-fourth to one-third the distance down toward the second end of compartment 32. When an object is engaged with the internal threads 40, most of the area within hole 38 forms a central storage area 42 in which an individual can store a plurality of lens cups 44 in the event the existing lens cup becomes damaged or contaminated.

Wetting solution compartment 46 has two ends, a first end and a second end, and includes an internal volume of sterile solution 54. The compartment 46 is cylindrically shaped for most of its length, which tapers off into a cone-shaped dispenser 48 located on the first end of the compartment 46. Compartment 46 has two sets of external threads located on its outside perimeter. The first set of external threads 50 is located at the second end of the compartment 46, while the second set of external threads 52 is located at the first end of the compartment 46 immediately before the compartment 46 begins to taper off into a cone at the dispenser 48.

In normal storage, the first set of internal threads 50 is engaged with the internal threads 40 located in hole 38 at the first end of the compartment 32. Compartment 46 is made from a somewhat flexible material, allowing squeezing of the compartment 46 to eject sterile solution 54 out of the dispenser 48.

Cover 56 has two ends, a first end and a second end, and has a hole 58 located on the first end of cover 56. Cover 56 also has an internal compartment 60 which occupies about half of the volume within cover 56 closest to the second end of cover 56. Hole 58 connects to compartment 60 and has internal threads 61 located around its inner perimeter, with the threads 61 capable of being threadably engaged to the set of external threads 52 on the wetting solution compartment 46.

When cover 56 is attached to the wetting solution compartment 46, dispenser 48 is located within compartment 60 of cover 56. To protect accidental leakage, a lens cup 62 is placed over dispenser 48.

Combination apparatus also includes two pivotable clips 70 and 72 which are pivotally attached to the second end of the compartment 32. They are attached at points one hundred eighty degrees from each other. Each of the clips are concave in shape and loop out and back in, with the free end of each clip being located in very close proximity to the wetting solution compartment 46.

When an individual wants to eject some of the sterile solution 54 through the dispenser 48, they can do this one of two ways. One way is to press downward on the free end of each of the clips 70 and 72, causing the free end of the clips 70 and 72 to place pressure on the wetting solution compartment 46, causing some of the sterile solution 54 to be ejected through the dispenser 48. The other way an individual can accomplish this task is to press down on the wetting solution compartment 46 with their fingers, which causes the same result.

Although the present invention is designed to have several interest features, it should be noted that sterility of is not automatically granted by use of the present invention. Effective sterility can only be maintained by purging the lens cup with wetting solution prior to each use.

I claim:

1. A multi-function apparatus for use in combination with a plurality of contact lens, the apparatus comprising:

a container having a handle end and an applicator end, a pair of contact lens storage compartments comprising a first contact lens storage compartment and a second contact lens storage compartment, the first contact lens storage compartment having a first end and a second end, with the second end of the first contact lens storage compartment being the handle end of a combination apparatus, the first contact lens storage compartment being substantially cylindrically shaped, the second contact lens storage compartment having a first end and a second end, with the second end of the second contact lens storage compartment having a cylindrical extension, the second contact lens storage compartment being cylindrically shaped, means for removably attaching the second end of he second contact lens compartment to the first end of the first contact lens compartment, a contact lens cup storage compartment having a first end and a second end, means for attaching the second end of the contact lens cup storage compartment to the first end of the second contact lens storage compartment, a wetting solution compartment having a first end and a second end, means for attaching the second end of the wetting solution compartment to the first end of the contact lens cup storage compartment, a cover attached to the first end of the wetting solution compartment, and means for attaching the container to an item of clothing.

2. A multi-function apparatus according to claim 1 wherein the means for removably attaching the second end of the second contact lens compartment to the first end of the first contact lens compartment further comprises:

a first central hole, the first central hole located on the first end of the first contact lens storage compartment, the first central hole having an inner perimeter, a plurality of internal threads located on the inner perimeter of the first central hole, a plurality of external threads located on the cylindrical extension of the second contact lens storage compartment, and wherein the plurality of internal threads located on the inner perimeter of the first central hole and the plurality of external threads located on the cylindrical extension of the second contact lens storage compartment can be removably attached to one another.

3. A multi-function apparatus according to claim 2 wherein the means for attaching the second end of the contact lens cup storage compartment to the first end of the second contact lens storage compartment further comprises:

a second central hole, the second central hole located on the first end of the second contact lens storage compartment, the second central hole having an inner perimeter, a plurality of internal threads located on the inner perimeter of the second central hole, a plurality of external threads located on the cylindrical extension of the second contact lens storage compartment, and wherein the plurality of internal threads located on the inner perimeter of the second central hole and the plurality of external threads located on the second end of the wetting solution compartment can be removably attached to one another.

4. A multi-function apparatus according to claim 3 wherein the means for attaching the second end of the wetting solution compartment to the first end of the contact lens cup storage compartment further comprises:

a third central hole, the third central hole located on the first end of the lens cup storage compartment, the third central hole having an inner perimeter, a plurality of internal threads located on the inner perimeter of the third central hole, a plurality of external threads located on the cylindrical extension of the lens cup storage compartment, and wherein the plurality of internal threads located on the inner perimeter of the third central hole and the plurality of external threads located on the second end of the wetting solution compartment can be removably attached to one another.

5. A multi-function apparatus according to claim 1 wherein the means for attaching the container to an item of clothing comprises a pair of pivotable clips comprising a first pivotable clip and a second pivotable clip, each of the pivotable clips being attached to the container.

* * * * *